US012747877B2

(12) United States Patent
Karnik

(10) Patent No.: US 12,747,877 B2
(45) Date of Patent: Sep. 29, 2026

(54) SYSTEM AND METHOD FOR INDIRECT EVAPORATIVE COOLING

(71) Applicant: A.T.E. Enterprises Private Limited, Mumbai (IN)

(72) Inventor: Kalpesh Sudhir Karnik, Bengaluru (IN)

(73) Assignee: A.T.E. Enterprises Ltd., Mumbai (IN)

( * ) Notice: Subject to any disclaimer, the term of this patent is extended or adjusted under 35 U.S.C. 154(b) by 194 days.

(21) Appl. No.: 16/811,419

(22) Filed: Mar. 6, 2020

(65) Prior Publication Data

US 2020/0284452 A1 Sep. 10, 2020

(51) Int. Cl.
*F24F 6/04* (2006.01)
*F24F 3/14* (2006.01)

(52) U.S. Cl.
CPC ..... *F24F 6/04* (2013.01); *F24F 3/14* (2013.01); *F24F 2003/144* (2013.01); *F24F 2006/046* (2013.01)

(58) Field of Classification Search
CPC .... F24F 6/04; F24F 3/14; F24F 5/0035; F24F 2003/144; F24F 2006/046
See application file for complete search history.

(56) References Cited

U.S. PATENT DOCUMENTS

| | | | | |
|---|---|---|---|---|
| 3,877,244 | A * | 4/1975 | Di Peri | F24F 5/0035 62/314 |
| 4,023,949 | A | 5/1977 | Schlom et al. | |
| 6,523,604 | B1 | 2/2003 | Brooks et al. | |
| 6,539,731 | B2 | 4/2003 | Kesten et al. | |
| 7,567,888 | B2 | 7/2009 | Chang et al. | |
| 7,758,671 | B2 | 7/2010 | Kesten et al. | |
| 7,765,827 | B2 | 8/2010 | Schlom et al. | |
| 8,468,846 | B2 | 6/2013 | Vaidyanathan | |
| 8,635,878 | B2 | 1/2014 | Consoli | |
| 2016/0209087 | A1 | 7/2016 | Rayblat et al. | |
| 2017/0051940 | A1 * | 2/2017 | Horie | F24F 3/001 |
| 2020/0149767 | A1 * | 5/2020 | Salem | F24F 5/0035 |

FOREIGN PATENT DOCUMENTS

| | | | | |
|---|---|---|---|---|
| CN | 2401827 | Y | 10/2000 | |
| WO | WO2010101110 | A1 | 9/2010 | |
| WO | WO2012147153 | A1 | 11/2012 | |
| WO | WO2016010486 | A1 | 1/2016 | |
| WO | WO2017162996 | | 9/2017 | |
| WO | WO-2018191806 | A1 * | 10/2018 | F24F 5/0035 |

OTHER PUBLICATIONS

Chapter 3—Heating, Ventilating, and Air Conditioning Systems in Smart Building Systems for Architects, Owners and Builders, ISBN 978-1-85617-653-8, 2010, pp. 31-46.
Bogdan Porumb et al., A review of indirect evaporative cooling technology, Energy Procedia 85 (2016) 461-471, p. 462.

* cited by examiner

*Primary Examiner* — Tavia Sullens
(74) *Attorney, Agent, or Firm* — CM Law LLP; Orlando Lopez

(57) ABSTRACT

A cooling system using indirect evaporative cooling (IEC) is disclosed. The implementation discloses use of two stages of IEC with two separate IEC exchangers. The two-stages of IEC exchangers are arranged in a manner such that the prime air mover (primary blower) pulls (sucks) air through one exchanger (1st stage) and then pushes air through the other exchanger (2nd stage).

11 Claims, 9 Drawing Sheets

SYSTEM AND METHOD FOR INDIRECT EVAPORATIVE COOLING

CROSS-REFERENCE TO RELATED APPLICATIONS

This application claims priority to Indian Provisional Application No. 201921009125, filed Mar. 8, 2019, the entire contents of which are incorporated herein by reference and for all purposes.

TECHNICAL FIELD

The present disclosure relates to the field of indirect evaporative cooling system, and more specifically relates to multi-stage indirect evaporative cooling systems.

BACKGROUND

An evaporative cooling type heat exchanger cools air via evaporation of the liquid or water. Since, the evaporative cooling does not use a refrigerant or compressor, it is more energy efficient and consumes less energy. However, direct evaporative cooling increases the absolute humidity of the cooled air, as its mechanism is the exchange of heat between unsaturated air and water in direct contact.

Therefore, indirect evaporative cooling type heat exchangers are typically used to avoid the rise in absolute humidity resulting during cooling. In indirect evaporative cooling system, an evaporating liquid is used to indirectly cool the supply air. The indirect evaporative cooling achieves cooling by passing two streams of air through the non-communicating gaps separated by parallel heat exchange surfaces having alternate dry and wet passages. The first air stream, referred to as primary air stream, to be cooled, is passed through the dry passages, while simultaneously, a second air stream, referred to as a secondary air stream, is passed through the wet passages. The temperature difference between the first air stream and a thin film of the evaporating liquid on the other side of the heat exchange surfaces, that is the wet passage side, drives the heat flow from the first air stream to the thin film of evaporating liquid. The second air stream absorbs the heat from the thin film of the evaporating liquid by evaporation of the liquid with which it is in direct contact in the wet passages. The second air stream thus extracts the required latent heat from the wet heat exchange surfaces, thereby cooling the surfaces, and the passing first air stream in the dry passages. Indirect evaporative cooling heat exchangers are disclosed in US patents such as U.S. Pat. Nos. 6,523,604, 4,023,949, and 8,468,846, all of which are incorporated by reference herein in their entirety and for all purposes.

Typically, a single stage indirect evaporative cooling is used in a heat exchanger. Moreover, to achieve high wet bulb efficiency by using a single stage indirect evaporative cooling as a heat exchanger becomes a challenge. Further, designing an indirect evaporative cooling system with high efficiency and with large cooling capacity with a single heat exchanger is also a challenge because of issues related to scaling up to higher volumes of secondary air flows.

Further, in a multi-stage indirect evaporative cooling heat exchanger, few sections may have very high pressure build-up. The high pressure build-up may occur due to the presence of high resistance to air flow. The high resistance to the air flow may be caused due to the arrangement the two indirect evaporative cooling exchangers adjacent to each other and the first blower-motor combination configured to either suck or push the air through both the exchangers. A high negative pressure may occur before the blower-motor combination if the two indirect evaporative cooling exchangers are at the suction side or a high positive pressure may occur after the blower-motor combination if the two indirect evaporative cooling exchangers are arranged at the discharge side.

SUMMARY

In an implementation of the present disclosure, a cooling system using indirect evaporative cooling (IEC) is disclosed. The implementation discloses use of two stages of IEC with two separate IEC exchangers. The two-stages of IEC exchangers are arranged in a manner such that the prime air mover (primary blower) pulls (sucks) air through one exchanger (1st stage) and then pushes air through the other exchanger (2nd stage).

In one or more embodiments, a multistage indirect evaporative cooling system of these teachings includes a first stage indirect evaporative cooling heat exchanger system, a first blower motor combination configured to pull first stage primary air through the first stage indirect evaporative cooling heat exchanger system, a second blower motor combination located at an exit of first stage secondary air from the first stage indirect evaporative cooling heat exchanger system and configured to pull first stage secondary air through the first stage indirect evaporative cooling heat exchanger system, and a second stage indirect evaporative cooling heat exchanger system. The first blower motor combination is located between the first stage indirect evaporative cooling heat exchanger system and the second stage indirect evaporative cooling heat exchanger system and is also configured to push a first portion of the first stage primary air through the second stage indirect evaporative cooling heat exchanger system as second stage primary air, and to push a second portion of the first stage primary air through the second stage indirect evaporative heat exchanger system as second stage secondary air.

The combination of an indirect evaporative cooling (IEC) heat exchanger and the subsystem configured to provide water or fluid from a water tank to the IEC heat exchanger, the subsystem including the water tank, a pump and a water distribution system, is referred to as an indirect evaporative cooling heat exchanger system.

In one or more embodiments, the method of these teachings for achieving an efficiency of greater than 82% in a multi stage indirect evaporative cooling system includes placing a first blower motor combination between a first stage indirect evaporative cooling heat exchanger system and a second stage indirect evaporative cooling heat exchanger system, placing a second blower motor combination at an exit location of the first stage secondary air, pulling, using the first blower motor combination, first stage primary air through the first stage evaporative cooling heat exchanger system, pulling, using the second blower motor combination, first stage secondary air through the first stage indirect evaporative cooling heat exchanger system, pushing, using the first blower motor combination, a first portion of the first stage primary air through the second stage indirect evaporative cooling heat exchanger system, as second stage primary air, and pushing, using the first stage blower motor combination, a second portion of the first stage primary air through the second stage indirect evaporative cooling heat exchanger system as second stage secondary air, wherein the efficiency of greater than 82% is obtained.

A number of other embodiments are disclosed.

BRIEF DESCRIPTION OF THE DRAWINGS

The detailed description of the invention is described with reference to the accompanying figures.

DETAILED DESCRIPTION

The present disclosure discloses a system and method for indirect evaporative cooling (IEC), wherein the indirect evaporative cooling enables to achieve higher wet bulb efficiency. The present disclosure discloses at least two stages of indirect evaporative cooling with at least two separate indirect evaporative cooling exchangers. The at least two-stages of indirect evaporative cooling exchangers, are arranged such that that the prime air mover (primary blower) pulls (sucks) air through a first exchanger ($1^{st}$stage) and then pushes air through the second exchanger ($2^{nd}$stage).

"Wet bulb efficiency," as used herein, is the ratio of the difference between inlet and outlet air temperature to the difference between inlet air temperature and its wet bulb temperature.

"Wet-bulb temperature (WBT)," as used herein, is the temperature read by a thermometer covered in water-soaked cloth (wet-bulb thermometer) over which air is passed.

"Wet-bulb depression," as used herein, is the difference between the dry-bulb temperature and the wet-bulb temperature.

In an exemplary embodiment, in accordance with the present disclosure, air is pulled (sucked) through a first exchanger while pushing air through the second exchanger. The present embodiment enables pressure distribution of the air at the suction and at the discharge side of the blower, thereby reducing the pressure throughout the indirect evaporative cooling system. The exemplary embodiment reduces the creation of high pressures in various sections within the indirect evaporative cooling system.

Figure 1:
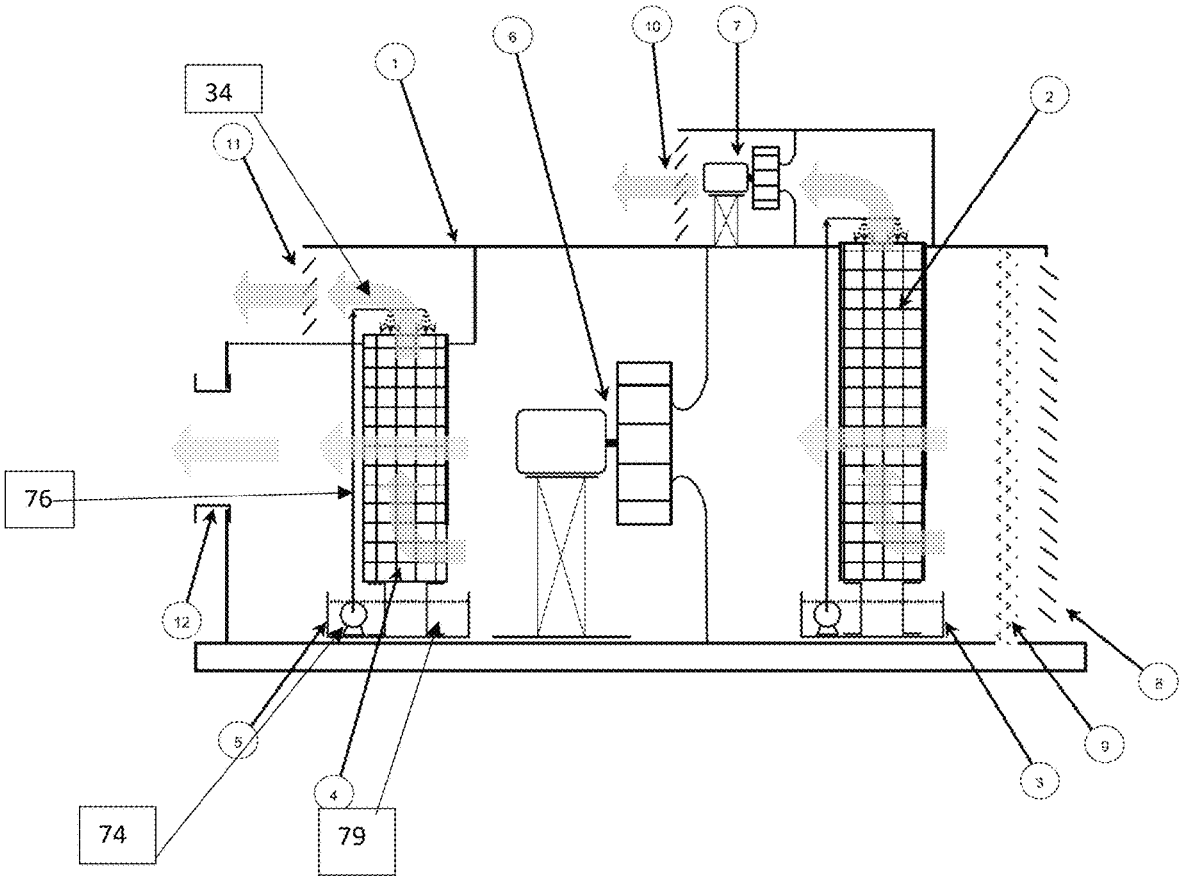
FIG. 1 is a schematic illustration of a cooling system with two stage indirect evaporative cooling heat exchanger, in accordance with an aspect of the present disclosure.
Figure 7:
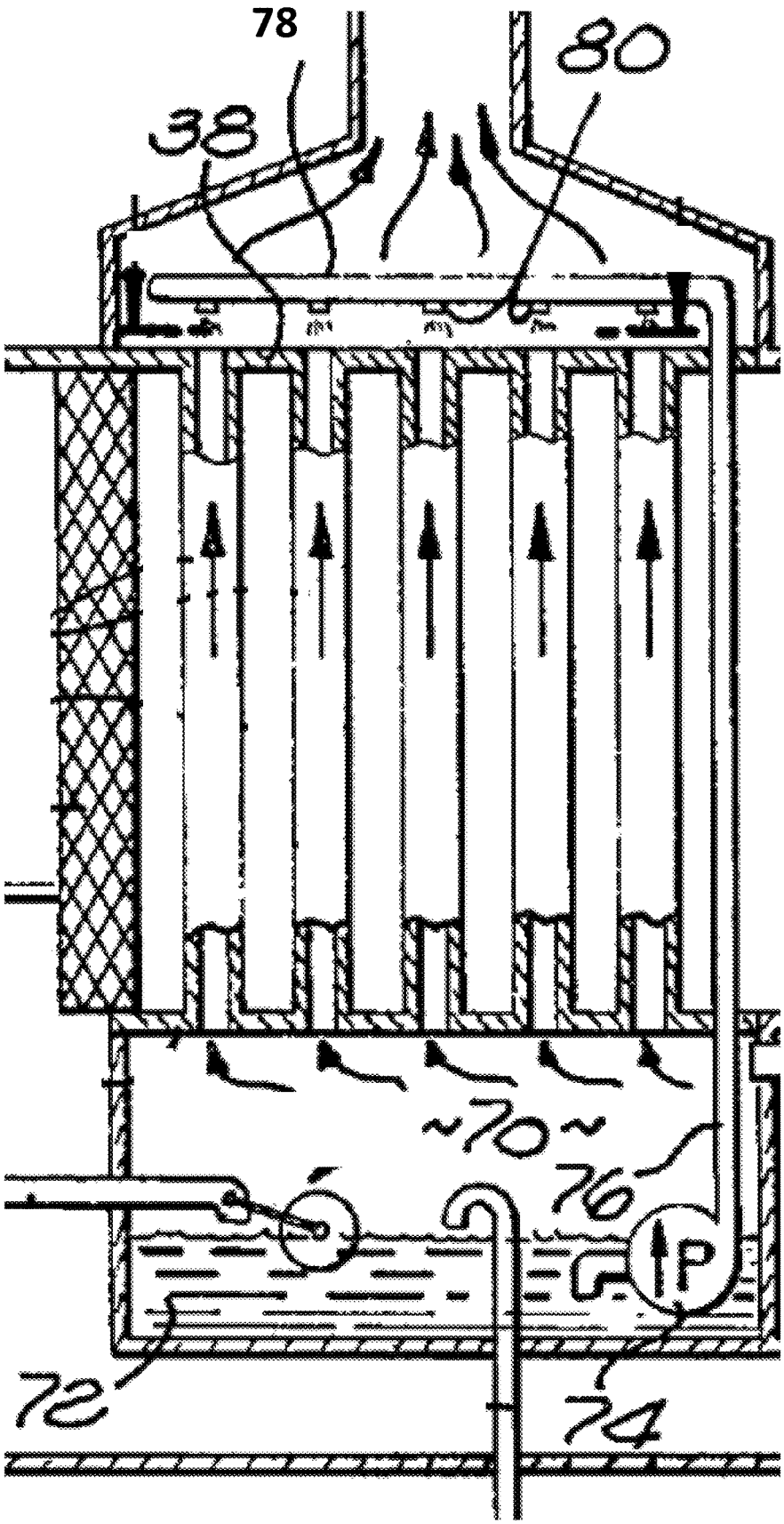
Fig. 7 (Prior Art)
FIG. 7 is a diagrammatic elevational view of a portion of a specific embodiment of an evaporative cooler system embodying basic concepts disclosed in U.S. Pat. No. 4,023,949.
Figure 8A:
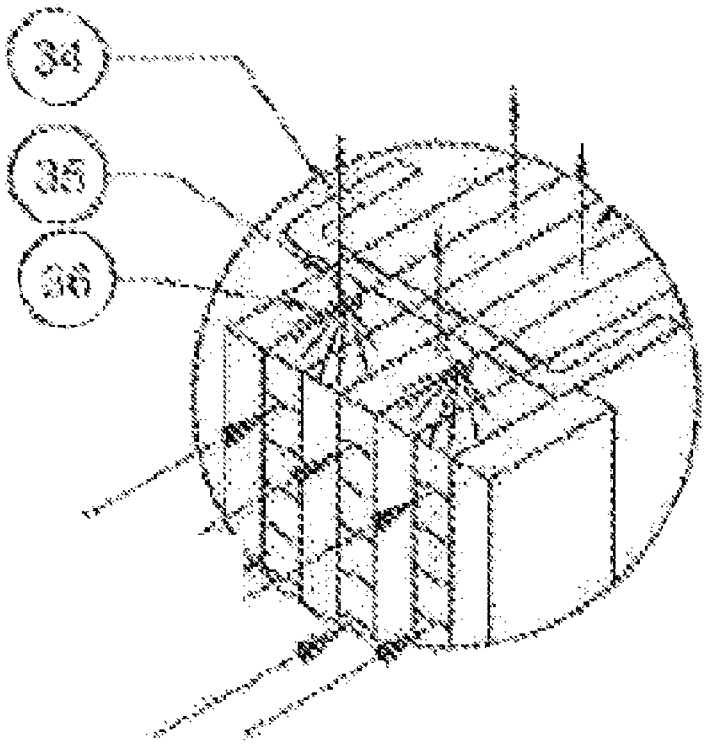
Fig. 8A (Prior Art)
FIGS. 8A and 8B are isometric views of portions of an embodiment of the indirect evaporative heat exchanger of U.S. Pat. No. 8,468,846.
Figure 8B:
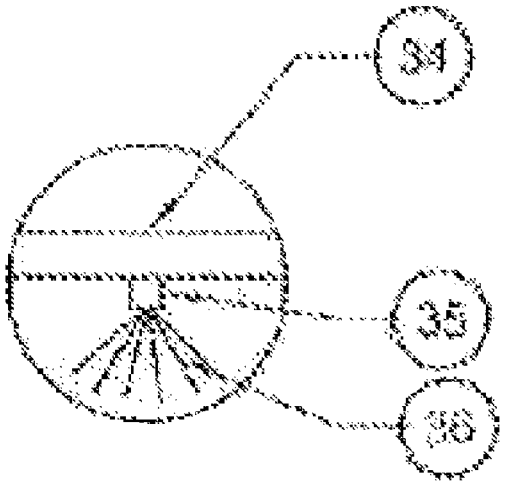
Fig. 8B (Prior Art)

FIG. 1 illustrates a cooling system in accordance with an aspect of the present disclosure. The cooling system may comprise a body (1) enclosing various components and subsystems mounted within the body for operation of the cooling system. The cooling system may further comprise at least two indirect evaporative cooling (IEC) heat exchangers, a first IEC heat exchanger (2) and a second IEC heat exchanger (4). Further, a first subsystem (3) comprising a first water tank, a first pump and a first water distribution system may be mounted in proximity to the first IEC heat exchanger (2). The first subsystem (3) may be configured to provide water or fluid from the water tank to the IEC heat exchanger (2) via the water distribution system, wherein the water is pumped by the pump into the water distribution system. FIG. 7 shows a diagrammatic view of a section of the evaporative cooler system disclosed in U.S. Pat. No. 4,023,949. Referring to FIG. 7, plenum 70 serves as a sump for containing a reservoir of water 72 for evaporation. The water 72 is fed by means of a water pump 74 and a suitable pipeline 76 to an array of manifold tubes 78 overlying the top header 38. The water 72 emerges from jets 80 in the manifold tube array 78 onto the top header 38. Other methods of water distribution than the manifold 78 can be used. For example, a trough network can be disposed over the top header 38 whereby water flows by gravity through notches in the sides of the troughs. Alternatively, a water trough system can be constructed integral with the top header 38 whereby the troughs would be disposed between the tubes and the water would flow from the troughs into and down through the tubes directly. FIGS. 8A and 8B show details of one embodiment of the two stage evaporative cooling apparatus disclosed in U.S. Pat. No. 8,468,846. Referring to FIGS. 8A and 8B, a water distribution cartridge 34 is fitted with misting systems that provide uniform spray water. The misting system is detailed as 35 and the water spray as 36. FIG. 1, for each IEC heat exchanger, shows a pump 74, providing, through a pipeline 76, fluid to a water distribution cartridge 34. The combination of an IEC heat exchanger and the subsystem configured to provide water or fluid from a water tank to the IEC heat exchanger, the subsystem including the water tank 79, a pump 74, a pipeline 76 and a water distribution system, is referred to as an indirect evaporative cooling heat exchanger system. The cooling system, in this embodiment, further comprises a second motor blower set (7) positioned, after an output end of the first IEC heat exchanger (2), and before the second IEC heat exchanger (4). (The second motor blower set (7) positioned, after an output end of the first IEC heat exchanger (2), and before a first secondary exhaust (10).)

The cooling system in accordance with the present disclosure may further comprise a first blower motor set (6) positioned between the first IEC heat exchanger (2) and the second IEC heat exchanger (4). Further a second subsystem (5) comprising a second water tank, a second pump and a second water distribution may be mounted in proximity to the second IEC heat exchanger (4). The second subsystem (5) may be configured to provide water or fluid from the water tank to the second IEC heat exchanger (4) via the water distribution system, wherein the water is pumped by the pump into the water distribution system. Further exhaust from the second IEC heat exchanger (4) is exhausted from a second secondary exhaust (11).

The cooling system may further comprise a fresh air inlet (8) and a filter (9) at one end of the cooling system and a primary air outlet/primary air exhaust (12) at the other end of the cooling system.

In another exemplary embodiment the inlet faces of at least two stages of the IEC heat exchanger have sections to take in the primary air as well as the secondary air. The first blower-motor combination pulls (sucks) air through the inlet, through the filter and the 1st stage IEC exchanger.

Simultaneously, the second blower-motor combination for the 1st stage sucks in secondary air through the secondary path of the 1st stage IEC exchanger. The first blower-motor combination further pushes the same air through the 2nd stage IEC exchanger with some of the air being pushed through the path for the secondary air of the 2nd stage IEC exchanger. Unlike the 1st stage, in the 2nd stage IEC, both the primary air and secondary air flow are caused by a single blower-motor combination. In some embodiments, a third blower-motor combination that pulls the secondary air through the 2nd stage IEC exchanger is not required. (However, embodiments in which a third blower motor combination is used are also within the scope of these teachings.) A set of tank, pump and water distribution system for each of the IEC exchangers ensures wetting of the secondary side surfaces. The 1st stage IEC causes "sensible cooling" of the primary air that is driven by the wet bulb depression of the incoming fresh air. Thus, the sensibly cooled primary air is further sensibly cooled by the 2nd stage IEC, driven by the wet bulb depression of the sensibly cooled primary air exiting the $1^{st}$ stage IEC. This improves the overall IEC efficiency.

Figure 2:
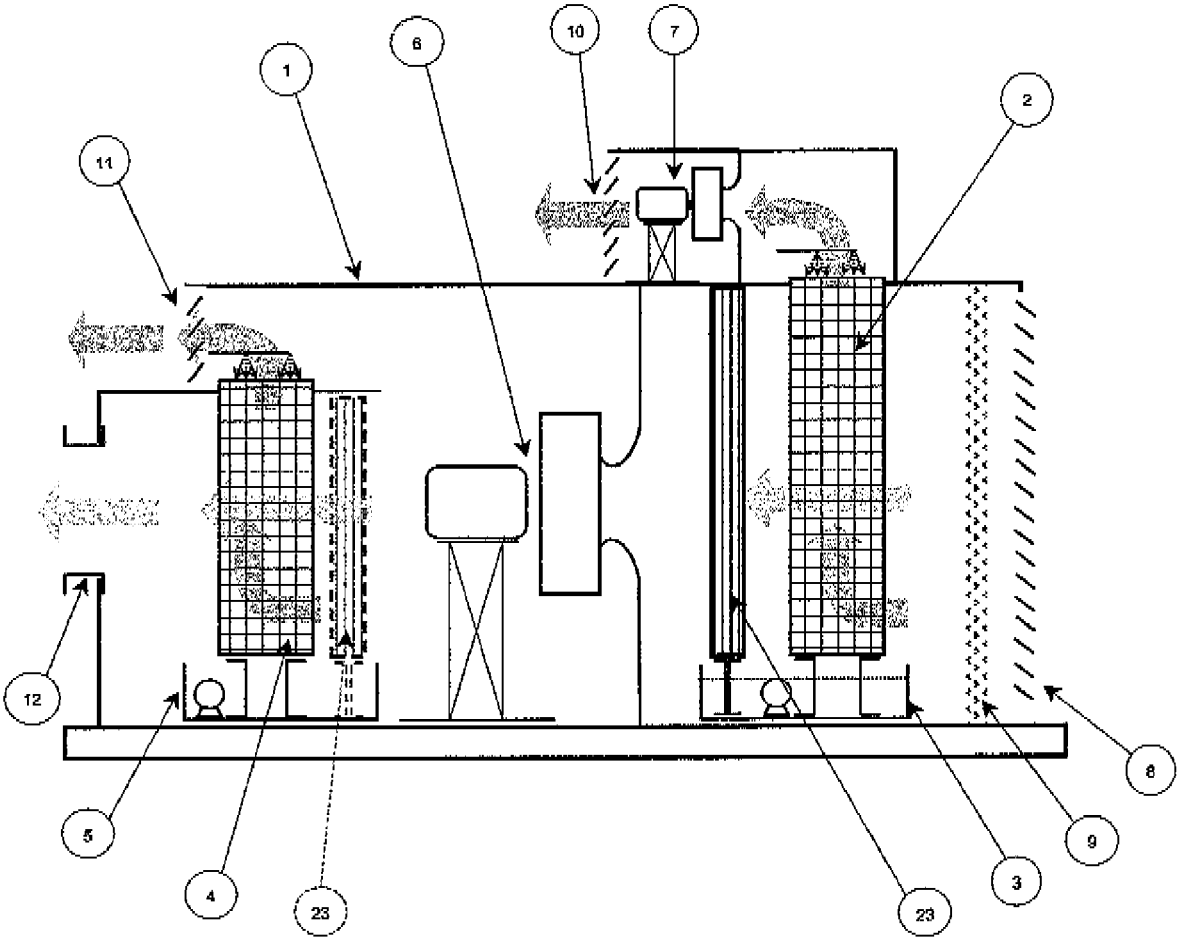
FIG. 2 shows a schematic representation of another embodiment of these teachings.

FIG. 2 shows a schematic representation of another embodiment of these teachings. In the embodiment shown in FIG. 2, a dehumidification stage (23) is placed at least one of two possible locations. In one embodiment, the dehumidification stage (23) is placed between the first blower motor combination (6) and the first stage indirect evaporative cooling (IDEC) heat exchanger (2) and configured to receive the first stage primary air. In another embodiment, the dehumidification stage (23) is placed between the first blower motor combination (6) and the second stage indirect evaporative cooling heat exchanger (4). The dehumidification stage (23) can be based on a number of technologies such as adsorption chemicals (see, for example, International Application Publication No. WO2010101110 and International Application Publication No. WO2012147153, all of which are incorporated by reference herein in their entirety and for all purposes) and separation membranes (for separation membranes, see, for example, International Application Publication No. WO2016010486, U.S. Pat. No. 6,539,731, or U.S. Pat. No. 7,758,671, all of which are incorporated by reference herein in their entirety and for all purposes). As can be seen from the above references (incorporated by reference) the dehumidification stage includes the accessories required for the operation of the working of the dehumidification stage. For example, a membrane for this purpose will require another air stream to carry away the moisture. Adsorption chemicals may require a means of heating to regenerate them again.

Figure 3:
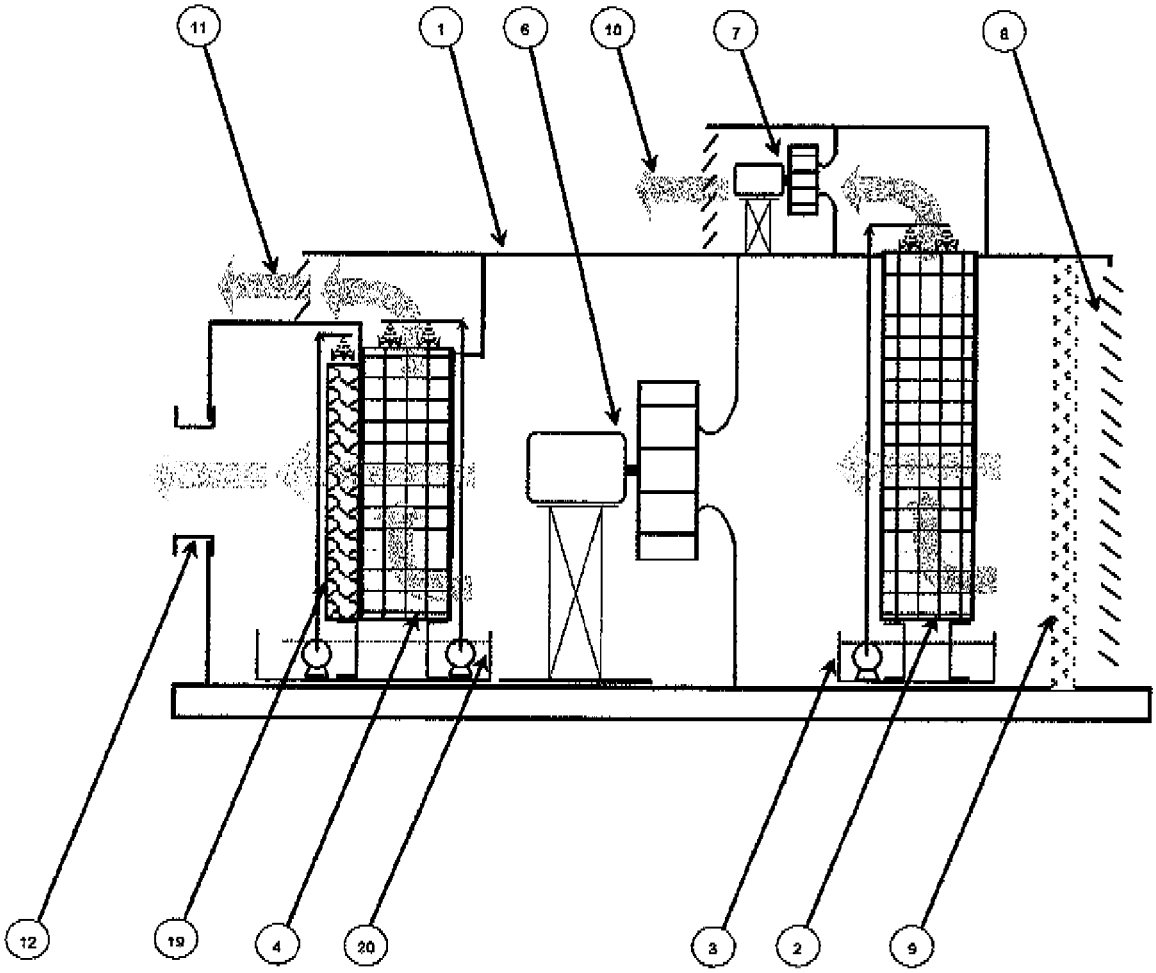
FIG. 3 shows a schematic representation of an embodiment including an additional 3rd stage using direct evaporative cooling.

In another embodiment, shown in FIG. 3, a direct evaporative cooling (DEC) heat exchanger system (19) is located after the second stage indirect evaporative cooling (IEC) heat exchanger (4) and configured to receive the second stage primary air. The consequent indirect-direct evaporative cooling (IDEC) heat exchanger system includes the indirect evaporative cooling (IEC) heat exchanger (4), the direct evaporative cooling (DEC) heat exchanger (19), a water tank, water pump and water distribution system. (The water tank for the DEC could be combined with the water tank for the second stage indirect evaporative cooling (IEC) heat exchanger system, which is part of the subsystem 20 that provides water or fluid to the second stage indirect evaporative cooling heat exchanger system.) The primary air, after being sensibly cooled by the first and the second stages, would pass through the DEC based $3^{rd}$ stage which will cool the air further by adiabatic cooling.

Figure 4:
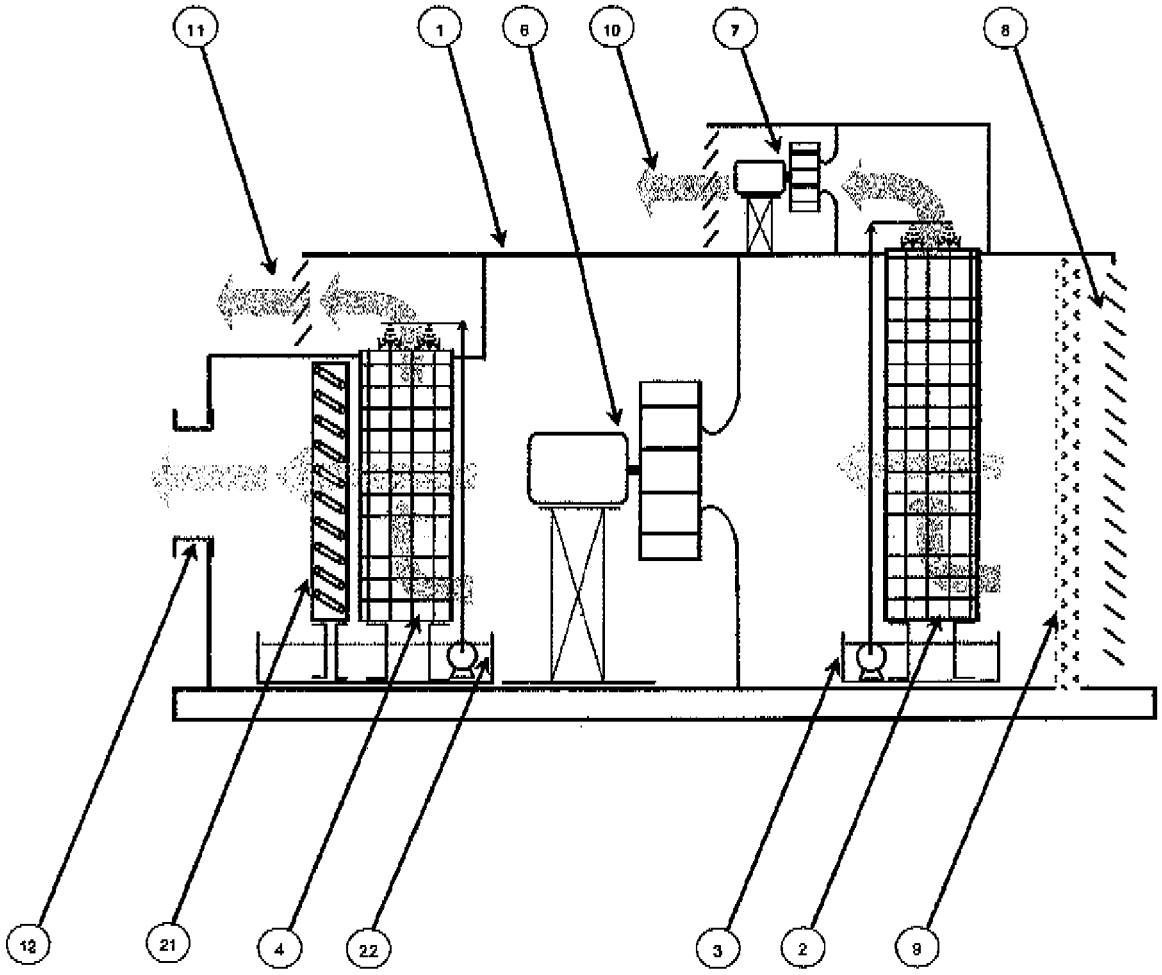
FIG. 4 shows a schematic representation of an embodiment including an additional 3rd stage using direct expansion (DX)/chilled water or chiller system cooling.

In yet another embodiment, shown in FIG. 4, direct expansion (DX)/chilled water or a chiller system cooling system is located after the second stage indirect evaporative cooling (IEC) heat exchanger (4), and configured to receive the second stage primary air. The direct expansion (DX)/chilled water cooling system includes a direct expansion (DX)/chilled water cooling heat exchanger (21) and a water tank for collecting condensate or a chiller (21). (In one instance, the tank, which is part of the subsystem 22 that provides water or fluid for the 2nd stage of cooling, could also serve as the tank to collect condensate.) A chiller system uses heat exchanges and circulate fluid or gas to cool the air that is passed through the chiller. (See, for example, Chapter 3—Heating, Ventilating, and Air Conditioning Systems in Smart Building Systems for Architects, Owners and Builders, ISBN 978-1-85617-653-8, 2010, Pages 31-46 and U.S. Pat. No. 7,567,888, both of which are incorporated by reference herein in their entirety and for all purposes). As can be seen from the above references (incorporated by reference) the chiller system includes the accessories required for the operation of the working of the chiller.

The primary air after being sensibly cooled by the first and the second stage would pass through the DX/chilled water coil based 3rd stage or chiller system that will cool the air sensibly and could, in some instances, dehumidify the air by condensing some of the moisture in the primary air. The occurrence of dehumidification would depend on the temperature of the coil being lower than the dew point temperature of the primary air.

Figure 5:
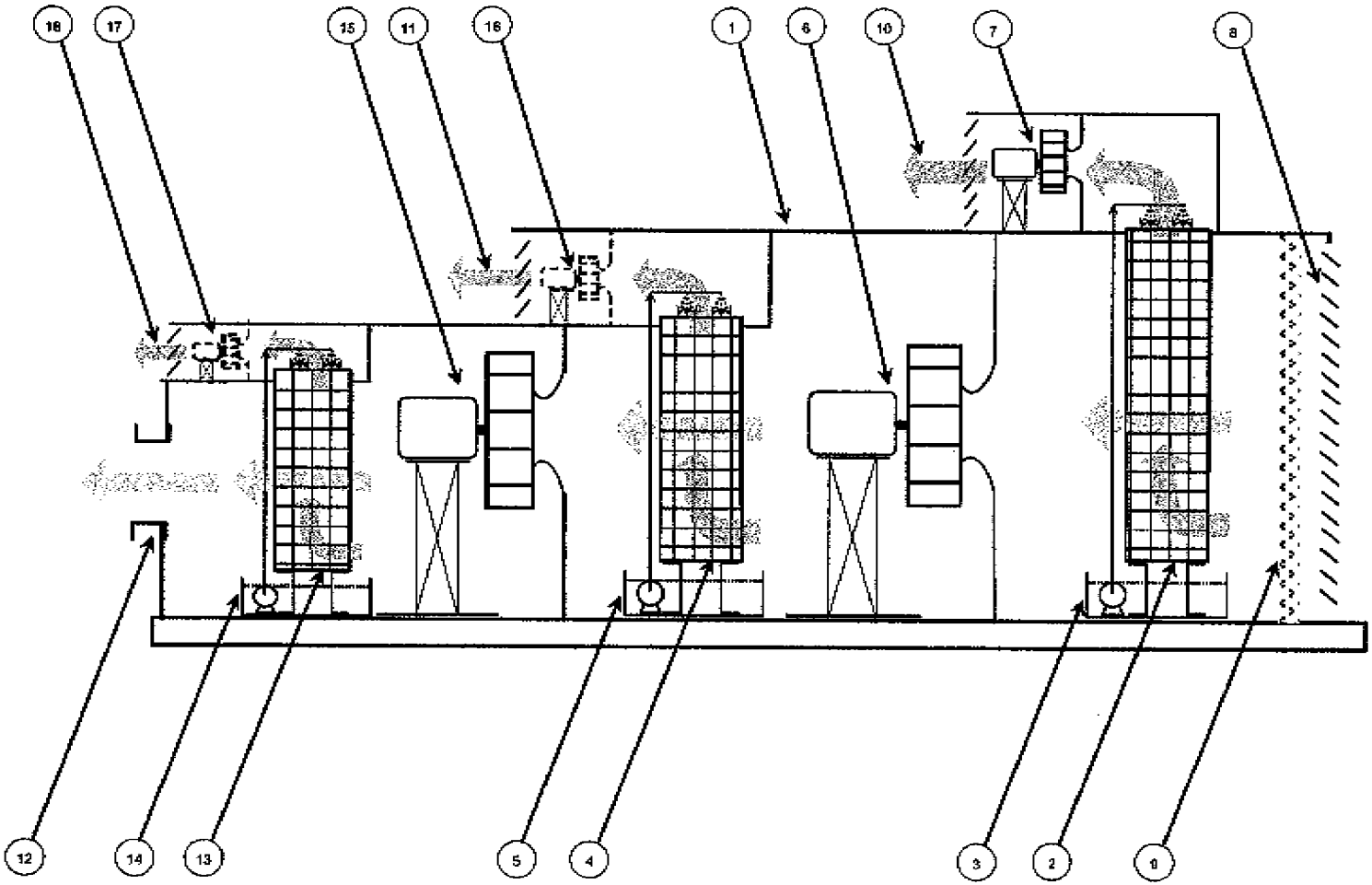
FIG. 5 shows an embodiment of the multistage indirect evaporative cooling system of these teachings that includes three stages of indirect evaporative cooling.

The multistage indirect evaporative cooling system of these teachings can include more than two stages. FIG. 5 shows an embodiment of the multistage indirect evaporative cooling system of these teachings that includes three stages of indirect evaporative cooling. The embodiment shown in FIG. 5 includes an additional 3rd stage IEC exchanger (13), its associated water tank, pump, and water distribution (14) and a third blower-motor set (15) required to ensure that the pressure requirements are distributed and the maximum pressure anywhere within the machine is moderate. A fourth blower-motor set (16), shown in dotted lines, may or may not be required depending on the operating pressure developed by the first blower-motor set and the required pressure for the required quantity of secondary air to pass through the secondary path of the 2nd stage IEC exchanger. A fifth blower-motor set (17), also shown in dotted lines, may or may not be required depending on the operating pressure developed by the third blower-motor set and the required pressure for the required quantity of secondary air to pass through the secondary path of the 3rd stage IEC exchanger. If a fifth blower-motor set (17) is required, further exhaust from the third IEC heat exchanger (13) is exhausted from a third secondary exhaust (18).

Figure 6:
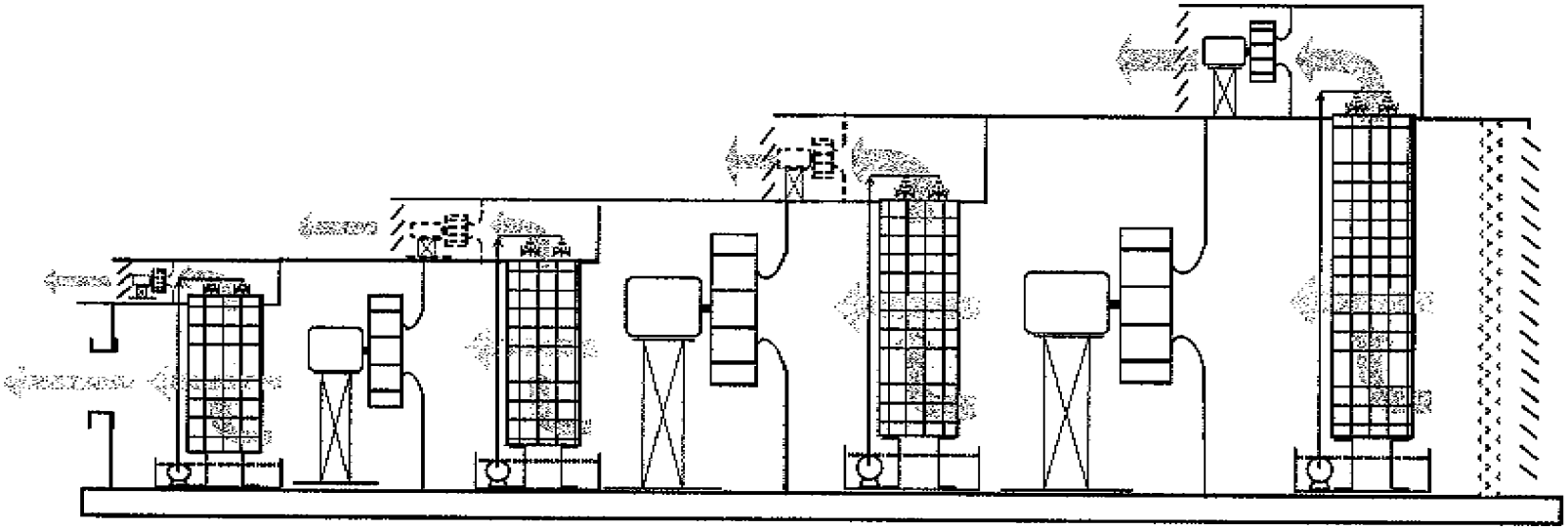
FIG. 6 shows a schematic depiction of a four-stage multistage indirect evaporative cooling system of these teachings.

FIG. 6 shows a depiction of a four-stage multistage indirect evaporative cooling system of these teachings. The additional exchanger and blower-motor set follows the design philosophy as disclosed above for the three-stage IEC machine.

The method of these teachings achieves higher wet bulb efficiency values, even higher than 100% in some cases, using indirect evaporative cooling (IEC). The invention achieves high efficiency by using at least two stages of IEC with at least two separate IEC exchangers.

The indirect evaporative cooling (IEC) heat exchangers used in this method can be of any design including polymer-based plate-type cross-flow exchangers having alternating paths for the primary air and secondary air with the surfaces of the path for the secondary air conducive to being wet with water. The inlet faces of each of the stages of the heat exchanger may have sections to take in the primary air as well as the secondary air.

According to the method of these teachings, a first blower motor combination is placed between a first stage indirect evaporative cooling heat exchanger system and a second stage indirect evaporative cooling heat exchanger system. A second blower motor combination is placed at an exit location of the first stage secondary air. Using the first blower motor combination, first stage primary air is pulled (sucked) through the first stage evaporative cooling heat exchanger system. Using the second blower motor combination, first stage secondary air is concurrently pulled (sucked) through the first stage indirect evaporative cooling heat exchanger system. Using the first blower motor combination, a first portion of the first stage primary air is pushed through the second stage indirect evaporative cooling heat exchanger system, as second stage primary air. Using the first stage blower motor combination, a second portion of the first stage primary air is pushed through the second stage indirect evaporative cooling heat exchanger system as second stage secondary air. The "sensible cooling" of the first stage primary air followed by the sensible cooling of the second stage primary air results in an IEC efficiency (wet bulb efficiency) of greater than 82% at a predetermined wet bulb depression (such as air wet bulb depression of 6° C.).

For a three stage system, the method also includes placing a third blower motor combination between a second stage indirect evaporative cooling heat exchanger system and a third stage indirect evaporative cooling heat exchanger system. Using the third blower motor combination, second stage primary air is pulled (sucked) through the second stage evaporative cooling heat exchanger system. Using the third blower motor combination, a first portion of the second stage primary air is pushed through the third stage indirect evaporative cooling heat exchanger system, as third stage primary air. Using the third blower motor combination, a second portion of the second stage primary air is pushed through the third stage indirect evaporative cooling heat exchanger system as third stage secondary air. The above steps can be repeated for subsequent stages such as for a four stage system.

Although, in the above described embodiments, the section to take in primary air and the section to take in secondary air are both on the inlet face of the indirect evaporative cooling exchanger of both the first stage IEC exchanger and the second stage IEC exchanger, embodiment using plate type heat exchangers, where the secondary air in one or both the IEC stages can be from another adjacent face, such as the bottom face of the exchangers, are also within the scope of these teachings.

To demonstrate and test the teachings disclosed hereinabove of 2-stage Indirect Evaporative Cooling (IEC), two IEC units are used in series:

6000 cfm IEC machine (Machine1—IDECool 6 only with DAMA (Dry air Moist air)) that is coupled with 4000 cfm IEC machine (Machine2—IDECool 4 only with DAMA) to replicate these teachings. (The IDECool machines with DAMA units use the system and method disclosed in U.S. Pat. No. 8,468,846.)

Both machines have DAMA units that are 400 mm deep. Machine1 is provided with ambient air, which is passed through 1$^{st}$ stage of IEC. Then the cooled air (primary air) is fed to Machine2, the 2nd stage IEC following the teachings disclosed hereinabove. The ratio of secondary to primary air (S/P) was maintained at 28% in Machine1 and at 50% in Machine2.

The performance of the set-up was measured for various ambient air conditions and highest wet-bulb depression available. Table 1 shows three sample measurement readings with least error in temperature values, air leakage, water leakage and serviced water distribution system.

TABLE 1

Cooling performance of two-stage IEC at different WB depression at machine inlet.

| Trial | DBT (° C.) | WBT (° C.) | WBD (° C.) | Ambient RH | Efficiency of the 1$^{st}$ stage | Efficiency of the 2$^{nd}$ stage | Wet bulb efficiency of the 2-Stage system |
|---|---|---|---|---|---|---|---|
| 1 | 28.5 | 22.5 | 6 | 60.6% | 53.3% | 48.6% | 83.3% |
| 2 | 30.5 | 23 | 7.5 | 53.8% | 60.0% | 54.8% | 90.7% |
| 3 | 30 | 21 | 9 | 45.6% | 64.4% | 55.1% | 94.4% |

Although the present disclosure has been described in the context of certain aspects and embodiments, it will be understood by those skilled in the art that the present disclosure extends beyond the specific embodiments to alternative embodiments and/or uses of the disclosure and obvious implementations and equivalents thereof. Thus, it is intended that the scope of the present disclosure described herein should not be limited by the disclosed aspects and embodiments above.

The invention claimed is:

1. A multistage indirect evaporative cooling system comprising:

a first stage indirect evaporative cooling heat exchanger system comprising a first stage indirect evaporative cooling heat exchanger, a water tank, a pump, and a water distribution system, said water distribution system comprising an arrangement of components, arranged to distribute water for evaporation and a pipeline from the pump to the arrangement of components, the water distribution system providing moisture to the first stage indirect evaporative cooling heat exchanger;

a first blower motor combination configured to pull a first stage primary air stream through the first stage indirect evaporative cooling heat exchanger system;

a second blower motor combination located at an exit of a first stage secondary air stream from the first stage indirect evaporative cooling heat exchanger system and configured to pull the first stage secondary air stream through the first stage indirect evaporative cooling heat exchanger system; a face of the first stage indirect evaporative cooling heat exchanger being located to receive air, said face having sections to take in the first stage primary air stream and sections to take in the first stage secondary air stream; and, a second stage indirect evaporative cooling heat exchanger system comprising a second stage indirect evaporative cooling heat exchanger, a water tank, a pump and a water distribution system, the water distribution system comprising an arrangement of components, arranged to distribute water for evaporation and a pipeline from the pump to the arrangement of components, the arrangement of components providing moisture to the second stage indirect evaporative cooling heat exchanger;

the first blower motor combination being located between the first stage indirect evaporative cooling heat exchanger system and the second stage indirect evaporative cooling heat exchanger system; a face of the second stage indirect evaporative cooling heat exchanger being located to receive air from the first blower motor combination; said face having sections to take in a second stage primary air stream and sections to take in a second stage secondary air stream;

the first blower motor combination also being configured to pull the first stage primary air stream through the first stage indirect evaporative cooling heat exchanger system and also to push a first portion of the first stage primary air stream through the second stage indirect evaporative cooling heat exchanger system as the second stage primary air stream, and to push a second portion of the first stage primary air stream through the second stage indirect evaporative heat exchanger system as the second stage secondary air stream; wherein the first blower motor combination pulls the first stage primary air stream through the first stage indirect evaporative cooling heat exchanger system in a substantially straight linear direction as the second stage primary air stream and pushes the first portion of the first stage primary air stream in the substantially straight linear direction and also pushes the second portion of the first stage primary air stream, referred to as the second stage secondary air stream, such that in each respective indirect evaporative heat exchanger system the first stage primary air stream and the second stage primary air stream are passed through dry passages while simultaneously the first stage secondary air stream and the second stage secondary air stream are passed through wet passages.

2. The multistage indirect evaporative cooling system of claim 1 further comprising a dehumidifier disposed between the first stage indirect evaporative cooling heat exchanger system and the first blower motor combination.

3. The multistage indirect evaporative cooling system of claim 2 wherein the dehumidifier is one of an adsorption dehumidifier and separation membrane dehumidifier.

4. The multistage indirect evaporative cooling system of claim 1 further comprising a dehumidifier disposed between the first blower motor combination and the second stage indirect evaporative cooling heat exchanger system.

5. The multistage indirect evaporative cooling system of claim 4 wherein the dehumidifier is one of an adsorption dehumidifier and separation membrane dehumidifier.

6. The multistage indirect evaporative cooling system of claim 1 further comprising a direct evaporative cooling heat exchanger disposed to receive second stage primary air.

7. The multistage indirect evaporative cooling system of claim 1 further comprising a direct expansion cooling heat exchanger disposed to receive second stage primary air.

8. The multistage indirect evaporative cooling system of claim 1 further comprising:

a third stage indirect evaporative cooling heat exchanger system comprising a third stage indirect evaporative cooling heat exchanger, a water tank, a pump and a water distribution system, the water distribution system comprising an arrangement of components, arranged to distribute water for evaporation and a pipeline from the pump to the arrangement of components, the water distribution system providing moisture to the third stage indirect evaporative cooling heat exchanger;

a third blower motor combination located between the second stage indirect evaporative cooling heat exchanger system and the third stage indirect evaporative cooling heat exchanger system;

the third blower motor combination also being configured to push a first portion of the second stage primary air stream through the third stage indirect evaporative cooling heat exchanger system as a third stage primary air stream, and to push a second portion of the second stage primary air stream through the third stage indirect evaporative heat exchanger system as a third stage secondary air stream; the third stage primary air stream is passed through dry passages while simultaneously the third stage secondary air stream is passed through wet passages.

9. The multistage indirect evaporative cooling system of claim 1 wherein a wet bulb efficiency of greater than 80% is obtained.

10. A method for achieving an efficiency of greater than 82% in a multi-stage indirect evaporative cooling system, the method comprising:

placing a first blower motor combination between a first stage indirect evaporative cooling heat exchanger system and a second stage indirect evaporative cooling heat exchanger system; the first stage indirect evaporative cooling heat exchanger system comprising a first stage indirect evaporative cooling heat exchanger, a water tank, a pump and a water distribution system comprising an arrangement of components, arranged to distribute water for evaporation and a pipeline from the pump to the arrangement of components, to provide fluid to the first stage indirect evaporative cooling heat exchanger; a face of the first stage indirect evaporative cooling heat exchanger being located to receive air; said face having sections to take in a first stage primary air stream and sections to take in a first stage secondary air stream; the second stage indirect evaporative cooling heat exchanger system comprising a second stage indirect evaporative cooling heat exchanger, a water tank, a pump and a water distribution system, the water distribution system comprising an arrangement of components, arranged to distribute water for evaporation and a pipeline from the pump to the arrangement of components, the water distribution system providing moisture to the second stage indirect evaporative cooling heat exchanger; a face of the second stage indirect evaporative cooling heat exchanger being located to receive air from the first blower motor combination; said face having sections to take in a second stage primary air stream and sections to take in a second stage secondary air stream;

placing a second blower motor combination at an exit location of the first stage secondary air stream;

pulling, using the first blower motor combination, the first stage primary air stream through the first stage evaporative cooling heat exchanger system;

pulling, using the second blower motor combination, the first stage secondary air stream through the first stage indirect evaporative cooling heat exchanger system;

pushing, using the first blower motor combination, a first portion of the first stage primary air stream through the second stage indirect evaporative cooling heat exchanger system, as a second stage primary air stream; wherein the first blower motor combination pulls the first stage primary air stream through the first stage indirect evaporative cooling heat exchanger system in a substantially straight linear direction and pushes the first portion of the first stage primary air stream, referred to as the second stage primary air stream, in the substantially straight linear direction; and pushing, using the first blower motor combination, a second portion of the first stage primary air stream through the second stage indirect evaporative cooling heat exchanger system as a second stage secondary air stream; in each respective indirect evaporative cooling heat exchange system, the first stage primary air stream and the second stage primary air stream being passed through dry passages while simultaneously the first stage secondary air stream and the second stage secondary air stream are passed through wet passages;

wherein the efficiency of greater than 82% is obtained.

11. The method of claim 10 further comprising:

placing a third blower motor combination between the second stage indirect evaporative cooling heat exchanger system and a third stage indirect evaporative cooling heat exchanger system;

pulling, using the third blower motor combination, the second stage primary air stream through the second stage evaporative cooling heat exchanger system;

pushing, using the third blower motor combination, a first portion of the second stage primary air stream through the third stage indirect evaporative cooling heat exchanger system, as a third stage primary air stream; and pushing, using the third stage blower motor combination, a second portion of the second stage primary air stream through the third stage indirect evaporative cooling heat exchanger system stage as a third stage secondary air stream; the third stage primary air stream being passed through dry passages while simultaneously the third stage secondary air stream is passed through wet passages.

* * * * *